US008638235B2

(12) United States Patent
Beiner

(10) Patent No.: US 8,638,235 B2
(45) Date of Patent: Jan. 28, 2014

(54) METHOD FOR CONTROLLING A LIGHTING SYSTEM

(75) Inventor: Dirk Beiner, Paderborn (DE)

(73) Assignee: Traxon Technologies Europe GmbH, Paderborn (DE)

( * ) Notice: Subject to any disclaimer, the term of this patent is extended or adjusted under 35 U.S.C. 154(b) by 113 days.

(21) Appl. No.: 13/144,064

(22) PCT Filed: Dec. 29, 2009

(86) PCT No.: PCT/DE2009/001824

§ 371 (c)(1),
(2), (4) Date: Sep. 30, 2011

(87) PCT Pub. No.: WO2010/078863

PCT Pub. Date: Jul. 15, 2010

(65) Prior Publication Data

US 2012/0025738 A1 Feb. 2, 2012

(30) Foreign Application Priority Data

Jan. 9, 2009 (DE) ..... 10 2009 003 331

(51) Int. Cl.
*G08B 5/00* (2006.01)
*G09G 5/02* (2006.01)

(52) U.S. Cl.
USPC ..... 340/815.65; 340/815.43; 345/593

(58) Field of Classification Search
USPC ..... 340/815.6, 815.62, 815.63, 815.65, 340/815.43, 815.45; 362/85, 231, 233, 234; 315/219, 312
See application file for complete search history.

(56) References Cited

U.S. PATENT DOCUMENTS

| | | | | |
|---|---|---|---|---|
| 7,173,384 | B2 * | 2/2007 | Plotz et al. | 315/291 |
| 7,354,172 | B2 * | 4/2008 | Chemel et al. | 362/231 |
| 7,948,394 | B2 * | 5/2011 | Bergman et al. | 340/815.65 |
| 2006/0072172 | A1 * | 4/2006 | Loew | 358/518 |
| 2008/0203943 | A1 | 8/2008 | Baaijens et al. | |
| 2009/0174332 | A1 | 7/2009 | Sejkora | |

FOREIGN PATENT DOCUMENTS

| | | |
|---|---|---|
| CN | 1950791 | 4/2007 |
| CN | 101151942 | 3/2008 |
| CN | 101199238 | 6/2008 |
| DE | 20 2007 003 457 U1 | 6/2007 |
| DE | 10 2006 055 615 | 10/2007 |
| WO | WO 2005/107338 | 11/2005 |
| WO | WO 2006/056958 | 6/2006 |
| WO | WO 2006/103600 | 10/2006 |
| WO | WO 2007/105151 | 9/2007 |
| WO | WO 2009/024903 | 2/2009 |
| WO | WO 2009/150572 | 12/2009 |

OTHER PUBLICATIONS

Office Action dated Sep. 18, 2013 issued in the corresponding Chinese Patent Application No. 200980157987.5.

* cited by examiner

*Primary Examiner* — Vibol Tan
(74) *Attorney, Agent, or Firm* — Cozen O'Connor

(57) ABSTRACT

A method for controlling a lighting system by means of an operating element and at least one color display, wherein the color display (3) can represent all colors of the RGB color space (F) with variable intensity, wherein, when the operating element is touched, the color of the light emitted by the lighting system is altered in such a way that it traverses the RGB color space (F) on a predetermined trajectory (A) and the color display (3) assumes the color of the light emitted by the lighting system.

12 Claims, 2 Drawing Sheets

METHOD FOR CONTROLLING A LIGHTING SYSTEM

RELATED APPLICATIONS

This is a U.S. national stage of application No. PCT/DE2009/001824, filed on Dec. 29, 2009.

This patent application claims the priority of German application no. 10 2009 003 331.9 filed Jan. 9, 2009, the disclosure content of which is hereby incorporated by reference.

FIELD OF THE INVENTION

The invention is related to a method for controlling a lighting system by means of an operating element and at least one color display, wherein the color display can represent all colors of the RGB color space with variable intensity and assumes the color of the light generated by the lighting system.

BACKGROUND OF THE INVENTION

The control of lighting systems that can emit light in different colors and brightnesses is usually performed by means of an operating panel with switches and regulators. In this case, separate switches and/or regulators are provided for setting the hue, the color saturation and the intensity.

In the case of the lighting system LivingColors from Philips, a regulator is embodied as a touch-sensitive sensor in the form of a circle by means of which, depending on the position of further switches, the hue, the color saturation and the intensity are set. In this case, the sensor is permanently provided with the colors of the chromatic circle. During regulation of the hue, the colors of the chromatic circle are run through, and the color saturation is set between the saturated hue and white. The brightness of the chosen color is influenced with the intensity.

Therefore, all three parameters of a desired light have to be set separately and successively.

SUMMARY OF THE INVENTION

One object of the invention is to provide a method for controlling a lighting system that allows a continuous variation of the hue and/or of the saturation of the emitted light of a lighting system with an optical supervision in an operating process.

In accordance with at least one embodiment of the method, the method makes it possible to control a lighting system by means of an operating element and at least one color display, wherein the color display can represent all colors of the RGB color space with variable intensity.

In accordance with at least one embodiment of the method, when the operating element is touched, the color of the light is altered in such a way that it traverses the RGB color space on a predetermined trajectory and the color display assumes the color of the light emitted by the lighting system.

Touching the operating element alters the color of the light generated by the lighting system. In this case, it is possible to alter both the hue, that is to say the saturated colors of the chromatic circle, and the color saturation between the saturated hue and the white point in one operating process.

The chromatic circle is represented in the RGB color space, which contains all saturated colors and the pastel shades thereof through to white.

The color display is able to represent all colors of the RGB color space. It assumes the respectively set color that is also emitted by the lighting system. When the operating element is touched, the color display alters its color in the same way as the color of the emitted light changes.

The alteration of the color when the operating element is touched is effected, then, such that the RGB color space is traversed on a predetermined trajectory.

Said trajectory can be defined such that the color of the light varies periodically between the saturated hues and the white point. Therefore, the colors firstly run through all the pastel shades before changing to a changed saturated hue.

In this way, the hue and its saturation are set in one operating process.

In another embodiment, the trajectory in the RGB color space can be configured such that only the intensity of the light is altered in the case of a preset color. Therefore, the emitted light is varied between bright and dark.

In a further embodiment, the trajectory in the RGB color space can be configured such that the color temperature of white light is altered continuously. The spectral component is therefore altered continuously from an overweighting of blue to an overweighting of red. Consequently, the mood based on the white light can be altered.

In one advantageous embodiment, the operating element is a touch sensor, which can detect a touch at different locations or a spatial alteration of the touch.

In the case of a spatial alteration of the touch, for instance in the form of a finger dragging over the surface of the touch sensor, part of the predetermined trajectory in the RGB color space is then traversed, for example the pastel shades of a hue currently set.

In the case of a relatively large spatial alteration, the traversed part of the trajectory can extend over a plurality of saturated hues and multiple traversal of the white point. In this case, it is advantageous if the speed at which the color is altered is coupled to the speed of the movement on the touch sensor. Thus, in the case of a slow alteration of the touch, a small part of the trajectory is traversed and a pastel shade can be set precisely. In the case of a fast movement on the sensor, the desired hues are reached rapidly.

A specific hue can also be reached rapidly if the operating element has identified locations at which a color indicated there is set directly by the operating element being touched in a punctiform fashion. The same effect can also be achieved for identified intensities of the light.

The direct selection of hue or intensity is supported if the locations of the operating element are in each case identified by color displays which indicate the color or intensity that can be set. Thus, the operating element can be designed in circular fashion and display elements that indicate the selectable color as a chromatic circle can be positioned at the outer edge of said operating element.

The arrangement of operating elements preferably comprises at least one control device by means of which a method for controlling a lighting system as described here is carried out. That is to say that the features of the method described here are also disclosed for the arrangement, and vice versa. The control device comprises, for example, at least one microprocessor.

BRIEF DESCRIPTION OF THE DRAWINGS

Embodiments of the invention are illustrated by way of example in the figures.

DETAILED DESCRIPTION OF THE DRAWINGS

Elements that are identical, of identical type or act identically are provided with the same reference symbols in the figures. The figures and size relationships of the elements illustrated in the figures among one another should not be regarded as to scale. Rather, individual elements may be illustrated with an exaggerated size in order to enable a better illustration and/or in order to afford a better understanding.

Figure 1:
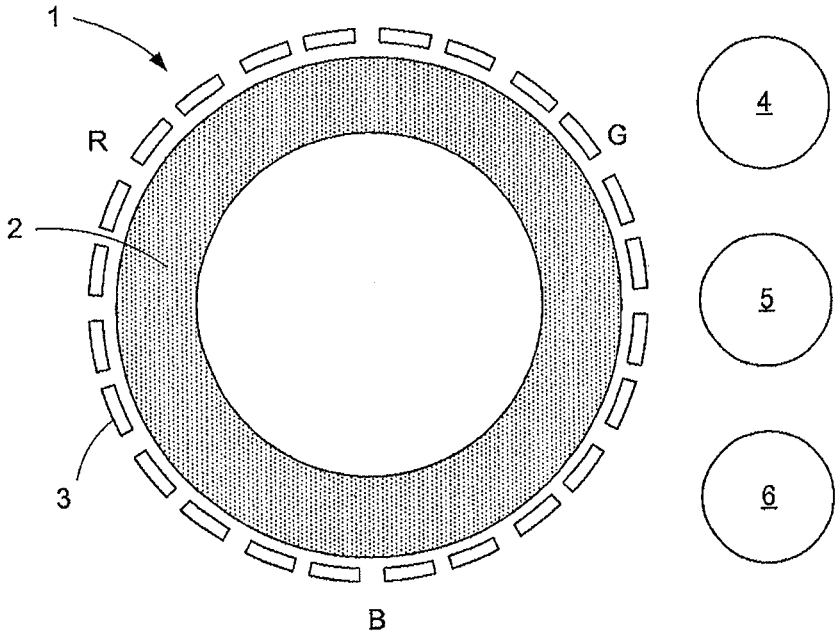
FIG. 1 shows a circular operating element with color displays arranged around it.

FIG. 1 illustrates an arrangement 1 of operating elements such as is used for implementing the method according to the invention.

The display elements that form the color display 3 are arranged in a circle. They can assume all colors of the RGB color space. In this illustration it is assumed that the chromatic circle is represented. It is identified by the letters RGB.

The circular touch sensor 2 is arranged within the display.

The display elements that form the color display 3 are each embodied in the form of a ring segment, for example. The display elements can complement one another to form a ring which is arranged at a distance from the touch sensor 2 of the operating element around said touch sensor. In this case, interspaces that are free of a display element can also be arranged between the individual display elements. Said interspaces can increase the contrast between the display elements.

The size of the display elements is chosen here to be identical in each case, for example. If interspaces are present between the display elements, then the display elements 3 are preferably arranged equidistantly with respect to one another. The display elements are furthermore preferably arranged uniformly around the touch sensor 2, such that the entire touch sensor 2 is surrounded by the display elements.

The display elements in each case comprise, for example, at least one three-color LED, or in each case consist of a three-color LED. A three-color LED can comprise, for example, one red, one green and one blue light-emitting diode chip.

A specific color can be selected by a punctiform movement on the touch sensor 2.

With a dragging movement on the touch sensor 2, a predetermined trajectory in the RGB color space can be traversed by the light. The instantaneous state of the emitted light is then represented in the entire ring of the display elements that form the color display 3. That is to say, for example, that the color display 3 simulates the light emitted by the lighting system in terms of its color and/or intensity.

This can be achieved particularly well when the lighting system itself comprises light-emitting diodes as luminous means. The lighting system comprises, in particular, a multiplicity of light-emitting diodes as luminous means. By way of example, the lighting system comprises a multiplicity of RGB light-emitting diodes, wherein each light-emitting diode chip of an RGB light emitting diode can be driven individually. In this way, it is possible that the RGB light-emitting diodes can emit light of a different color and intensity. The color of this light can be simulated particularly well by the display elements of the color display 3, which each comprise at least one RGB light-emitting diode.

The touch sensor 2 comprises touch-sensitive areas, for example, which are embodied in circular fashion as capacitive sensor areas that respond to a touch with a finger. The fact that the touch-sensitive areas of the touch sensor 2 are arranged in circular fashion means, in particular, that each touch-sensitive area is embodied as a segment of a circle or of a ring. The individual segments then complement one another to form a full circle or a full ring. Since the sensor areas are arranged in a closed circle, it is possible to evaluate the above-described different touches on the circle.

Further selection switches 4, 5, 6 are provided for controlling the light. Thus, the selection switch 4 can be an on/off switch. The setting of the hue is predefined by means of the selection switch 5, while brightness control is predefined by means of the selection switch 6.

Figure 2:
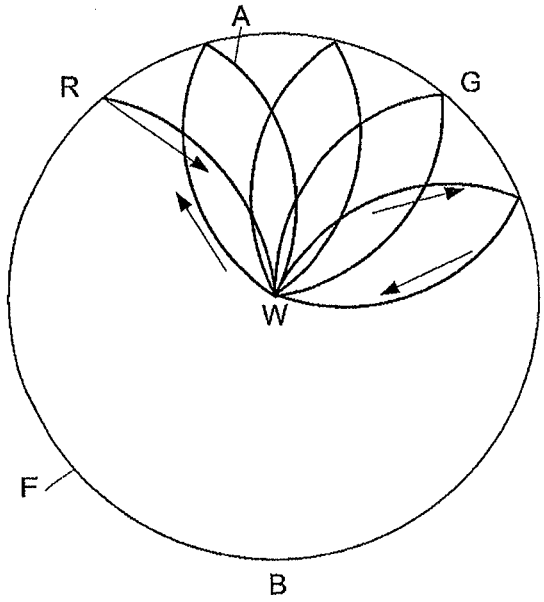
FIG. 2 shows a chromatic circle with a trajectory leading periodically to the white point.
Figure 3:
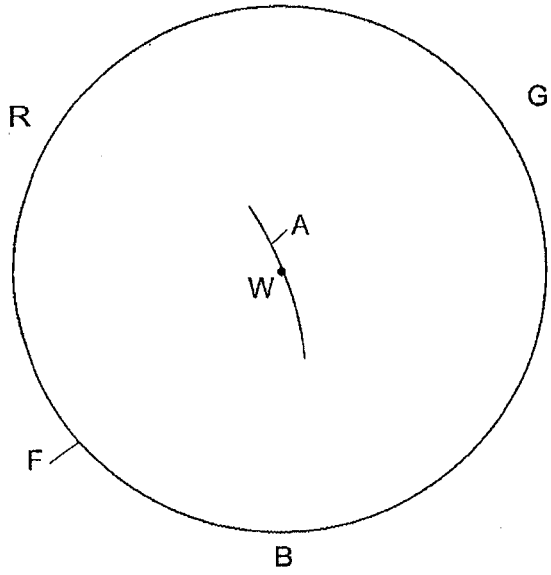
FIG. 3 shows a chromatic circle with a trajectory that changes the color temperature of white.

FIG. 2 and FIG. 3 illustrate the RGB color space as a circle F. The primary colors red R, green G and blue B are marked at the edges. The white point W is situated in the center of the color space F.

In FIG. 2, the trajectory A through the color space F is illustrated in a "flower pattern". Thus, here the setting of the hue begins at the saturated color red R, then leads to the white point W and returns to a saturated color between red and green. The trajectory subsequently leads once again to the white point W, and so on. The movement on the passage on the trajectory A through the color space F is identified by the arrows.

In the manner shown here, it is possible to move to the pastel-colored intermediate hues very precisely. In the case of a slow setting, the hue of the emitted light can be determined very precisely.

FIG. 3 illustrates the color temperature setting of white light. The trajectory A is led through the white point W as a neutral setting. The light can be altered in the direction of red R for warmer light or in the direction B for colder light.

The invention is not restricted to the exemplary embodiments by the description on the basis of said exemplary embodiments. Rather, the invention encompasses any novel feature and also any combination of features, which in particular includes any combination of features in the patent claims, even if this feature or this combination itself is not explicitly specified in the patent claims or exemplary embodiments.

The invention claimed is:

1. A method for controlling a lighting system with an operating element and at least one color display, wherein the at least one color display can represent all colors of an RGB color space with variable intensity, the method comprising:

detecting a touch to the operating element;

altering a color of light emitted by the lighting system when the touch to the operating element is detected such that the light emitted by the lighting system traverses the RGB color space on a predetermined trajectory and the at least one color display assumes the color of the light emitted by the lighting system;

wherein the RGB color space is traversed such that the color of the light emitted by the lighting system is periodically altered between a saturated color and a white point of the RGB color space.

2. The method according to claim 1, wherein an intensity of the light emitted by the lighting system is set as a preset color.

3. The method according to claim 1, further comprising:

setting a color temperature of white light.

4. The method according to claim 1, wherein the operating element is a touch sensor operable to detect a spatial alteration of the touch, and part of the predetermined trajectory in the RGB color space is traversed in accordance with the alteration.

5. The method according to claim 4, wherein a larger or smaller part of the predetermined trajectory is traversed depending on a speed of an alteration of the touch.

6. The method according to claim 4, wherein the operating element has identified locations at which a defined color or intensity of the light is set by the operating element being touched in a punctiform manner.

7. The method according to claim 6, wherein the identified locations of the operating element are each identified by color displays which indicate a settable color or intensity.

8. An arrangement comprising:

at least one operating element;

a lighting system having a plurality of light-emitting diodes comprising luminous means;

at least one color display; and at least one control device comprising at least one microprocessor;

wherein the control device is configured to control the lighting system with the at least one color display;

wherein the at least one color display is configured to represent all colors of an RGB color space with variable intensity;

wherein, when a touch to the at least one operating element is detected, a color of light emitted by the lighting system is altered such that the light emitted by the lighting system traverses the RGB color space on a predetermined trajectory and the at least one color display assumes the color of the light emitted by the lighting system; and wherein the RGB color space is traversed such that the color of the light emitted by the lighting system is periodically altered between a saturated color and a white point of the RGB color space.

9. The arrangement according to claim 8, wherein the lighting system comprises a plurality of RGB light-emitting diodes, wherein each light-emitting diode chip of an RGB light-emitting diode of the plurality of RGB light-emitting diodes is drivable individually.

10. The method according to claim 1, wherein the RGB color space is traversed in a flower pattern.

11. A method for controlling a lighting system with an operating element and at least one color display, wherein the at least one color display can represent all colors of an RGB color space with variable intensity, the method comprising:

detecting a touch to the operating element;

altering a color of light emitted by the lighting system when the touch to the operating element is detected such that the light emitted by the lighting system traverses the RGB color space on a predetermined trajectory and the at least one color display assumes the color of the light emitted by the lighting system;

wherein the RGB color space is traversed along the predetermined trajectory through the RGB color space such that the color of the light emitted by the lighting system is periodically altered between a saturated color and a white point of the RGB color space;

wherein the predetermined trajectory through the RGB color space is established in a pattern to set a hue of the light emitted from the lighting system, beginning at the saturated color, leading to the white point of the RGB color space and returning to another saturated color; and wherein the at least one color display assumes the color of the light emitted by the lighting system.

12. The method according to claim 11, wherein the pattern is a flower pattern.

* * * * *